US010197240B2

(12) United States Patent
Pickard

(10) Patent No.: US 10,197,240 B2
(45) Date of Patent: Feb. 5, 2019

(54) LIGHTING DEVICE

(75) Inventor: Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 12/546,915

(22) Filed: Aug. 25, 2009

(65) Prior Publication Data

US 2010/0177509 A1 Jul. 15, 2010

Related U.S. Application Data

(60) Provisional application No. 61/143,506, filed on Jan. 9, 2009.

(51) Int. Cl.

| | |
|---|---|
| ***F21V 3/00*** | (2015.01) |
| ***F21V 3/04*** | (2018.01) |
| ***F21V 3/06*** | (2018.01) |
| ***F21V 29/506*** | (2015.01) |
| *F21S 8/02* | (2006.01) |
| *F21Y 115/10* | (2016.01) |

(52) U.S. Cl.

CPC ..... *F21V 3/04* (2013.01); *F21V 3/062* (2018.02); *F21V 29/506* (2015.01); *F21S 8/02* (2013.01); *F21Y 2115/10* (2016.08)

(58) Field of Classification Search

CPC ..... F21V 3/06–3/0625; F21V 29/506
USPC ..... 362/249.02, 311.02–311.04
See application file for complete search history.

(56) References Cited

U.S. PATENT DOCUMENTS

| | | | | |
|---|---|---|---|---|
| 4,918,487 | A | 4/1990 | Coulter, Jr. | |
| 5,526,251 | A | 6/1996 | Andre et al. | |
| 5,611,163 | A | 3/1997 | Smith | |
| 5,631,190 | A | 5/1997 | Negley | |
| 5,739,639 | A | 4/1998 | Johnson | |
| 5,912,477 | A | 6/1999 | Negley | |
| 5,954,423 | A | 9/1999 | Logan et al. | |
| 6,600,175 | B1 * | 7/2003 | Baretz et al. | 257/100 |
| 6,793,369 | B2 * | 9/2004 | Calzaretta et al. | 362/219 |
| 7,307,391 | B2 * | 12/2007 | Shan | 315/291 |
| 2006/0030647 | A1 * | 2/2006 | Ebeling et al. | 524/115 |
| 2007/0139920 | A1 | 6/2007 | Van de Ven | |
| 2007/0139923 | A1 | 6/2007 | Negley | |
| 2007/0170447 | A1 | 7/2007 | Negley | |
| 2007/0171145 | A1 | 7/2007 | Coleman | |
| 2007/0236911 | A1 | 10/2007 | Negley | |
| 2007/0263393 | A1 | 11/2007 | Van de Ven | |
| 2007/0274063 | A1 | 11/2007 | Negley | |

(Continued)

OTHER PUBLICATIONS

Cyberlux, ReliaBright ELU, ReliaBright ELU Emergency Lighting Cyberlux Corporation, http://www.cyberlux.com, 1 page.

(Continued)

*Primary Examiner* — Sean Gramling
(74) *Attorney, Agent, or Firm* — Burr & Brown, PLLC

(57) ABSTRACT

A lighting device comprising at least one solid state light emitting light source, a power supply and a housing. The light source(s), and optionally also the power supply, is/are positioned within the housing. The power supply is configured to supply power to the light source(s). The housing comprises at least one substantially transparent light passing structure which comprises at least one thermoplastic material. When power is supplied to the light source, at least a portion of the light emitted by the source light passes through the light passing structure.

29 Claims, 2 Drawing Sheets

(56) References Cited

U.S. PATENT DOCUMENTS

2007/0274080 A1 11/2007 Negley
2007/0278934 A1 12/2007 Van de Ven
2007/0279440 A1* 12/2007 Negley ..... H05B 33/0827 345/691
2007/0279903 A1 12/2007 Negley
2007/0280624 A1 12/2007 Negley
2008/0084685 A1 4/2008 Van de Ven
2008/0084700 A1 4/2008 Van de Ven
2008/0084701 A1 4/2008 Van de Ven
2008/0088248 A1 4/2008 Myers
2008/0089053 A1 4/2008 Negley
2008/0106895 A1 5/2008 Van de Ven
2008/0106907 A1 5/2008 Trott
2008/0112168 A1 5/2008 Pickard
2008/0112170 A1 5/2008 Trott
2008/0112183 A1 5/2008 Negley
2008/0137347 A1 6/2008 Trott
2008/0278950 A1 11/2008 Pickard
2008/0278952 A1 11/2008 Trott
2008/0278957 A1 11/2008 Pickard
2008/0304261 A1 12/2008 Van de Ven
2008/0304269 A1 12/2008 Pickard
2008/0309255 A1* 12/2008 Myers ..... F21K 9/00 315/297
2009/0021841 A1 1/2009 Negley
2009/0108269 A1 4/2009 Negley
2009/0184666 A1 7/2009 Myers
2010/0085751 A1* 4/2010 Shaner ..... 362/249.02

OTHER PUBLICATIONS

Cyberlux, ReliaBright ELS, ReliaBright ELS Emergency Lighting System Cyberlux Corporation, http://www.cyberlux.com,2 pages.
Lithonia Lighting, LQM: LED Exit Signs, Lithonia Light—The best value in lighting—Product Catalog, http://lithonia.corn/products, 2 pages.
U.S. Appl. No. 13/368,177, filed Feb. 7, 2012, Pickard.

* cited by examiner

LIGHTING DEVICE

CROSS-REFERENCE TO RELATED APPLICATIONS

This application claims the benefit of U.S. Provisional Patent Application No. 61/143,506, filed Jan. 9, 2009, the entirety of which is incorporated herein by reference.

FIELD OF THE INVENTIVE SUBJECT MATTER

The present inventive subject matter relates to lighting devices which comprises one or more solid state light emitting light sources. In some aspects, the present inventive subject matter relates more particularly to lighting devices having a non-isolated power supply and/or configured to operate on a current of at least 65 volts.

BACKGROUND

There are a wide variety of situations where it is desired to provide a lighting device which employs a non-isolated power supply and/or where the lighting device is configured to operate on a current of at least 65 volts.

In such circumstances, in order to be listed under current UL 1598 standards, it is necessary for the lighting device to have structures and/or mechanisms to prevent accidental contact of a user with the active electrical components and to prevent hot material from escaping the lighting device in the event of fire. UL 1598 standards are well-known to persons of skill in the art, and descriptions of UL 1598 are readily available. In order for the lighting device to be energy-efficient, it is generally necessary for at least a portion of the barrier to have a high degree of translucency.

Barriers made of glass materials have been employed, and can satisfy the requirements specified above. Such glass materials, however, are often expensive to work with, and are prone to breaking during transit and/or installation.

It would be desirable to provide a lighting device which can be listed under current UL 1598 standards, and which avoids the need to provide a glass barrier.

BRIEF SUMMARY OF THE INVENTIVE SUBJECT MATTER

In accordance with the present inventive subject matter, there is provided a lighting device which meets the above objectives.

Materials other than glass could be used to make a barrier, i.e., at least part of the housing of a lighting device, if the material is UL 94 5VA rated, or (even if the material is not UL 94 5VA rated) if the material is UL 94 V0 rated and the barrier passes the UL 94 5VA 5 inch flame test. A statement that a material is "UL 94 5VA rated" means that the material passes the UL 94 5VA test. A statement that a material is "UL 94 V0 rated" means that the material passes the UL 94 V0 test. The UL 94 5VA test, the UL 94 V0 test, and the UL 94 5VA 5 inch flame test are all well-known to persons of skill in the art, and descriptions of these tests are readily available In accordance with the present inventive subject matter, there are provided lighting devices which each include a housing which comprises at least one barrier (i.e., a "light passing structure" or "lens") which is substantially transparent and which is "enclosure rated", i.e., in which either (1) the light passing structure is made of a material which is UL 94 5VA rated, or (2) the light passing structure is made of a material which is UL 94 V0 rated and the light passing structure passes the UL 94 5VA 5 inch flame test.

In some embodiments, the present inventive subject matter relates to a downlight with light sources comprising or consisting of solid state light emitters.

In accordance with an aspect of the present inventive subject matter, there is provided a lighting device that comprises a housing, the housing comprising at least one light passing structure.

In accordance with a first aspect of the present inventive subject matter, there is provided a lighting device comprising:

at least one solid state light emitting light source;

a power supply; and a housing, the at least one light source and the power supply being positioned within the housing, the power supply being configured to supply power to the at least one light source, the housing comprising at least one light passing structure, the light passing structure comprising at least one thermoplastic material, and the light passing structure being substantially transparent, wherein when power is supplied to the light source, the light source emits light source light, and at least a portion of the light source light passes through the light passing structure.

In accordance with a second aspect of the present inventive subject matter, there is provided a lighting device comprising:

at least one solid state light emitting light source;

a power supply; and a housing, the at least one light source being positioned within the housing, the power supply being configured to supply power to the at least one light source at a voltage of at least 65 volts, the housing comprising at least one light passing structure, the light passing structure comprising at least one thermoplastic material, the light passing structure being substantially transparent, wherein when power is supplied to the light source, the light source emits light source light, and at least a portion of the light source light passes through the light passing structure.

In some embodiments according to the present inventive subject matter, the at least one solid state light emitter comprises at least one light emitting diode, and/or the at least one solid state light emitter comprises at least one luminescent material.

In some embodiments according to the present inventive subject matter, the thermoplastic material comprises polycarbonate.

In some embodiments according to the present inventive subject matter, the thermoplastic material is UL 94 5VA rated.

In some embodiments according to the present inventive subject matter, the thermoplastic material is UL 94 V0 rated, and the light passing structure passes the UL 94 5VA 5 inch flame test.

In some embodiments according to the present inventive subject matter, when power is supplied to the light source, the light source light which passes through the light passing structure is not more than 20 MacAdam ellipses from the blackbody locus. In some embodiments according to the present inventive subject matter, when the lighting device is in operation, at least 200 lumens passes through the at least one light passing structure (in some of such embodiments, at least 300 lumens pass through the at least one light passing structure, and in some of such embodiments, at least 400 lumens pass through the at least one light passing structure).

In some embodiments according to the present inventive subject matter, the lighting device further comprises at least one optical layer, e.g., a diffuser film.

In some embodiments according to the first aspect of the present inventive subject matter, the power supply is configured to supply power to the at least one light source at a voltage of at least 65 volts The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
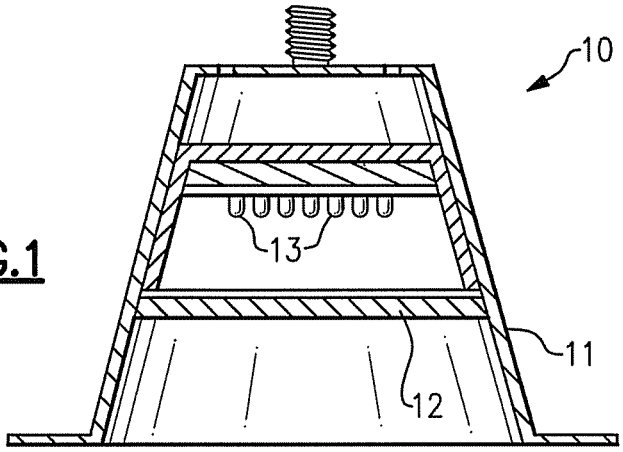
FIG. 1 is a cross-sectional view of a first embodiment of a lighting device according to the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural fauns as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Relative terms, such as "lower" or "bottom" and "upper" or "top," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "substantially transparent", as used herein with respect to a structure (e.g., a light passing structure), means that at least 70 percent of light (and in some cases, at least 85 percent or at least 95 percent) directed toward a structure passes through the structure. The expression "substantially transparent" encompasses structures which may be diffusing, so as to mix light that passes therethrough.

The expression "lighting device", as used herein, is not limited, except that it is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

As noted above, the present inventive subject matter is directed to a lighting device comprising at least one solid state light emitting light source, a power supply and a housing.

Any desired solid state light emitting light source can be employed in accordance with the present inventive subject matter. Persons of skill in the art are aware of, and have ready access to, a wide variety of light sources. In some embodiments according to the present inventive subject matter, the at least one solid state light emitter comprises at least one light emitting diode, and/or the at least one solid state light emitter comprises at least one luminescent material.

Any desired solid state light emitter or emitters can be employed in accordance with the present inventive subject matter. Persons of skill in the art are aware of, and have ready access to, a wide variety of such emitters. Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made).

The respective light emitters can be similar to one another, different from one another, or any combination (i.e., there can be a plurality of solid state light emitters of one type, or one or more solid state light emitters of each of two or more types).

More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode. Any of such devices can be used as solid state light emitters according to the present inventive subject matter.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished in a variety of ways, one representative way being by adding the luminescent materials to a clear or transparent encapsulant material (e.g., epoxy-based, silicone-based, glass-based or metal oxide-based material) as discussed above, for example by a blending or coating process.

For example, one representative example of a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. The first resin portion can be obtained by filling the cup reflector with a resin material and curing it after the light emitting diode chip has been mounted onto the bottom of the cup reflector and then has had its cathode and anode electrodes electrically connected to the leads by way of wires. A luminescent material can be dispersed in the first resin portion so as to be excited with the light A that has been emitted from the light emitting diode chip, the excited luminescent material produces fluorescence ("light B") that has a longer wavelength than the light A, a portion of the light A is transmitted through the first resin portion including the luminescent material, and as a result, light C, as a mixture of the light A and light B, is used as illumination.

Representative examples of suitable solid state light emitters, including suitable light emitting diodes, luminescent materials, encapsulants, etc., are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed. May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009-0108269), the entirety of which is hereby incorporated by reference as if set forth in its entirety.

As noted above, in some embodiments according to the present inventive subject matter, when power is supplied to the light source, the light source light which passes through the light passing structure is not more than 20 MacAdam ellipses from the blackbody locus. In some embodiments according to the present inventive subject matter, the light source light which passes through the light passing structure is not more than 10 MacAdam ellipses from the blackbody locus, and in some embodiments not more than 4 MacAdam ellipses. In other words, in some embodiments, the light output from the lighting device is white or near-white (i.e., it is light which would be perceived by normal human vision to be white or near-white).

As noted above, the light source can be any desired light source, a wide variety of which are readily available. With regard to embodiments in which the light source comprises one or more solid state light emitter, because light that is perceived as white is necessarily a blend of light of two or more colors (or wavelengths), in many of such embodiments, a plurality of solid state light emitters are provided which are of different colors which, when mixed, are perceived as white or near-white. Similarly, some embodiments of the present inventive subject matter include one or more solid state light emitter and one or more light sources which are not solid state light emitters, and the mixture of light is perceived as white or near-white.

For example, as is well-known, "white" light emitting diode lamps have been produced which have a light emitting diode pixel formed of respective red, green and blue light emitting diodes. Another "white" LED which has been produced includes (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of primary colors.

Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

The CRI of efficient white LEDs is generally low (Ra in the range 65-75) as compared to incandescent light sources (CRI Ra of 100). Additionally the color temperature for LEDs is generally "cooler" (~5500K) and less desirable than the color temperature of incandescent or CCFL bulbs (~2700K). Both of these deficiencies in LEDs can be improved by the addition of other LEDs or lumiphors of selected saturated colors. As indicated above, light sources according to the present inventive subject matter can utilize specific color "blending" of light sources of specific (x,y) color chromaticity coordinates (see U.S. patent application Ser. No. 11/613,714, filed Dec. 20, 2006 (now U.S. Patent Publication No. 2007/0139920), the entirety of which is hereby incorporated by reference as if set forth in its entirety). For example, light from additional selected saturated sources can be mixed with the unsaturated broad spectrum source(s) to provide uniform illumination without any areas of discoloration; and if desired, for cosmetic reasons, the individual light emitters can be made to be not visible as discrete devices or discrete color areas when the illumination source or aperture is viewed directly.

Light emitting diodes can thus be used individually or in any combinations, optionally together with one or more luminescent material (e.g., phosphors or scintillators) and/or filters, to generate light of any desired perceived color (including white).

Aspects related to the present inventive subject matter can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points which are each a common distance from a specified color point consist of hues which would each be perceived as differing from the specified hue to a common extent.

The chromaticity coordinates (i.e., color points) that lie along the blackbody locus obey Planck's equation: $E(\lambda)=A\lambda^{-5}/(e^{(B/T)}$, where E is the emission intensity, $\lambda$ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

As noted above, in the devices according to the present inventive subject matter, the power supply is configured to supply power to the at least one light source. The lighting devices of the present inventive subject matter can be supplied with electricity in any desired manner. Skilled artisans are familiar with a wide variety of power supplying apparatuses, and any such apparatuses can be employed in connection with the present inventive subject matter. The lighting devices of the present inventive subject matter can be electrically connected (or selectively connected) to any desired power source, persons of skill in the art being familiar with a variety of such power sources.

Representative examples of apparatuses and circuitry for supplying electricity to lighting devices and power supplies for lighting devices, all of which are suitable for the lighting devices of the present inventive subject matter, are described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety; and U.S. patent application Ser. No. 12/328,144, filed Dec. 4, 2008 (now U.S. Patent Publication No. 2009/0184666), the entirety of which is hereby incorporated by reference as if set forth in its entirety.

As noted above, in order for a lighting device to be listed under current UL 1598 standards where the lighting device employs a non-isolated power supply and/or is configured to operate on a current of at least 65 volts, it is necessary for the lighting device to have structures and/or mechanisms to prevent accidental contact of a user with the active electrical components and to prevent hot material from escaping the lighting device in the event of fire. The housings in accordance with the present inventive subject matter provide such protection, while allowing light to pass out of the housing without substantial losses of light, and while avoiding the use of glass. Accordingly, the lighting devices in accordance with the present inventive subject matter are suitable for use with isolated power supplies or with non-isolated power supplies. Similarly, the lighting devices in accordance with the present inventive subject matter are suitable for use with high voltage (i.e., 65 volts or more) or with low voltage (less than 65 volts).

As noted above, in the devices according to the present inventive subject matter, the housing comprises at least one light passing structure which comprises at least one thermoplastic material. In some embodiments, the housing further comprises one or more opaque or partially opaque structures or regions.

The opaque or partially opaque structure(s) or region(s) of the housing, when provided, can be made of any desired material, skilled artisans being familiar with a wide variety of such materials. For example, the opaque or partially opaque structure(s) or region(s) of the housing, when provided, can be made of metal or polymeric material which is UL 94 5VA rated.

The light passing structure can be in any desired shape, a wide variety of which are known to persons skilled in the art, and a wide variety of which might be desired in any particular situation.

The thermoplastic material or materials for use in making the light passing structure can be any desired material which satisfies the requirement specified herein in the context of the type of lighting device for which it is being used. For example, if the lighting device is desired to have a lens which is made of a material which is UL 94 5VA rated, the material must be selected from among those thermoplastic materials which are UL 94 5 VA rated and which are substantially transparent. If the lighting device is desired to employ a thermoplastic material which is UL 94 V0 rated and a light passing structure which passes the UL 94 5VA 5 inch flame test, the material must be selected from among those thermoplastic materials which are UL 94 V0 rated and the light passing structure must be thick enough that it passes the UL 94 5VA 5 inch flame test.

Polycarbonate materials which are UL 94 V0 rated and which can be used to make light passing structures which are substantially transparent and which pass the UL 94 5VA 5 inch flame test are available from Bayer MaterialScience, Teijin Chemicals Ltd., Kingfa Science and Technology Co., Ltd. and DuPont.

In some embodiments, the light passing structure comprises at least one material which has a Vicat softening temperature which is at least 85 degrees C.

The light passing structure can be made by any desired manufacturing method, a variety of which are well-known to those skilled in the art. In some embodiments, the light passing structure is made by injection molding.

As noted above, in some embodiments, the light passing structure is made to be thick enough that it can pass the UL 94 5VA 5 inch flame test. In some embodiments, for example, the light passing structure is at least 3 mm thick in the region closes to the electrical components which are closest to the light passing structure.

In some embodiments according to the present inventive subject matter, the light source comprises a plurality of solid state light emitters (e.g., a plurality of light emitting diodes), and the light passing structure assists in mixing different colored light emitted from the different solid state light emitters, and/or the light passing structure assists in obscuring the solid state light emitters from a user's view. In some embodiments, the light passing structure assists in obscuring the solid state light emitters to such an extent that the min-max surface brightness ratio would be not greater than about 10:1 (i.e., in the range of from 1:1 to about 10:1), and in some embodiments would be: in the range of from 1:1 to about 5:1; in the range of from 1:1 to about 3:1; and/or in the range of from 1:1 to about 2:1, e.g., in the range of from about 3:1 to about 4:1 or in the range of from about 1.5:1 to about 3:1. Persons of skill in the art are familiar with min/max ratios, and are readily able to measure and compare min/max ratios of various lighting devices.

The housing of the lighting devices in accordance with the present inventive subject matter can be of any desired shape or size, and can include any of a wide variety of additional structures.

For example, housings, fixtures, other mounting structures and complete lighting assemblies which may be used in practicing the present inventive subject matter are described U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety; and U.S. patent application Ser. No. 12/116,348, filed on May 7, 2008 (now U.S. Patent Publication No. 2008/0278957), the entirety of which is hereby incorporated by reference as if set forth in its entirety.

As noted above, in the first aspect in accordance with the present inventive subject matter, the at least one light source is positioned within the housing and in the second aspect in accordance with the present inventive subject matter, the at least one light source and the power supply are positioned within the housing.

The expression "light source being positioned within housing", as used herein, means that the housing includes points which are on both sides of the light source relative to each of three orthogonal axes extending through the light source.

For example, FIG. 1 depicts an embodiment of a lighting device 10 which comprises a housing and a plurality of light sources. Referring to FIG. 1, the housing can include an opaque section 11 formed of metal (e.g., aluminum) and a light passing structure 12 formed of thermoplastic material. The light sources can comprise a plurality of LEDs 13. In this embodiment, the housing can completely surround the LEDs 13 (and therefore can include points which are on both sides of the light sources relative to each of three orthogonal axes extending through the light source).

Figure 2:
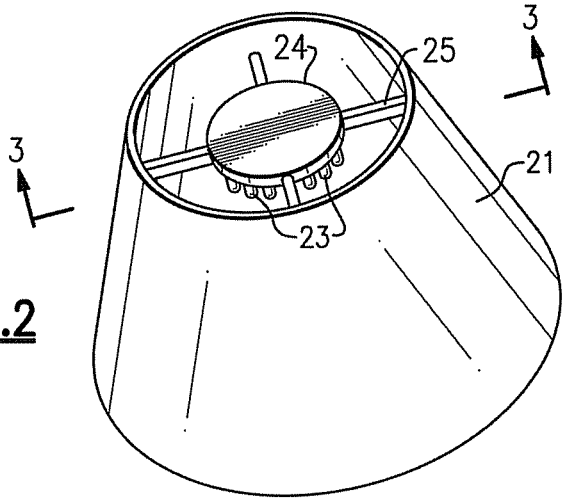
FIG. 2 is a perspective view of a second embodiment of a lighting device according to the present inventive subject matter.
Figure 3:
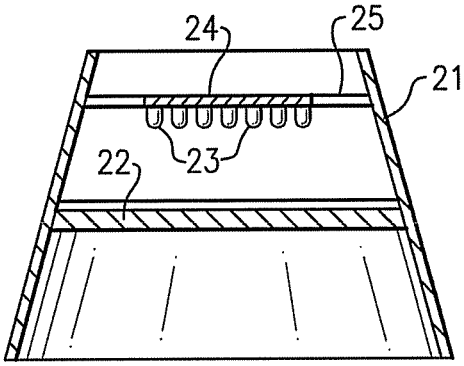
FIG. 3 is a cross-sectional view of the second embodiment depicted in FIG. 2.
Figure 4:
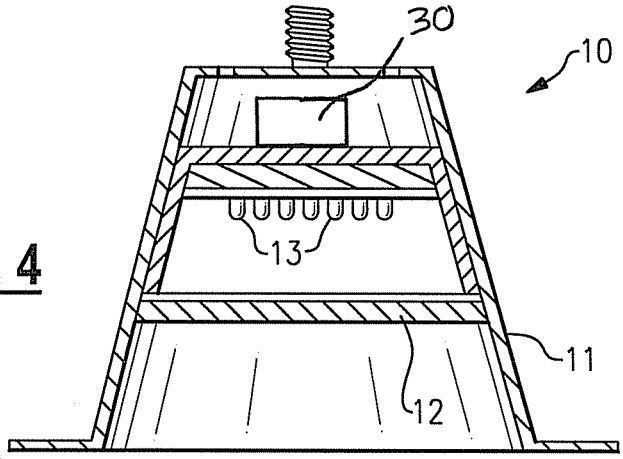
FIG. 4 is a cross-sectional view of an embodiment of a lighting device schematically showing a power supply 30 positioned within a housing of the lighting device, according to the present inventive subject matter.

FIGS. 2 and 3 depict a second embodiment of a lighting device 20 which can comprise a housing and a plurality of light sources. Referring to FIG. 3, the housing can include an opaque section 21 and a light passing structure 22, and the light sources can comprise a plurality of LEDs 23. In the embodiment depicted in FIGS. 2 and 3, even though the housing can be constructed such that it does not completely surround the LEDs 23 (i.e., the top is open), the housing can include points which are on both sides of the light sources relative to each of three orthogonal axes extending through the light source, and thus, the light sources are positioned within the housing. In this embodiment, the LEDs 23 can be mounted on a support 24 that can be held in place by bridges 25 that each can comprise a heat pipe.

The expression "light source and power supply being positioned within housing", as used herein, means that the housing includes points which are on both sides of the light source relative to each of three orthogonal axes extending through the light source and includes points which are on both sides of the power supply relative to each of three orthogonal axes extending through the light source.

As noted above, in some embodiments according to the present inventive subject matter, the lighting device further comprises at least one optical layer, e.g., a diffuser film. In such embodiments, the optical layer can be any desired optical layer, a variety of which are well-known to persons skilled in the art. In such embodiments, the optical layer can be mechanically held in place or may be molded as part of the light passing structure.

For example, an optical layer can be molded as part of the light passing structure by using a film insert molding technique. Representative examples of such molding techniques are described in U.S. patent application Ser. No. 12/174,053, filed Jul. 16, 2008 (now U.S. Patent Publication No. 2009/0021841), the entirety of which is hereby incorporated by reference as if set forth in its entirety.

One or more optical layers, when included, can be made out of any desired material or materials, and persons skilled in the art are familiar with such materials. A representative example of a group of materials which can be used to form such a layer or layers is polycarbonate materials.

If the optical layer, e.g., diffuser film, is molded as part of the light passing structure, the molding temperature of the material used to make the light passing structure should be low enough to prevent substantial destruction of the optical layer. For example, a polycarbonate diffuser film from Luminit may be insert molded with a polycarbonate material from Teijin to provide a flame-rated light passing structure with an integral diffuser. Alternatively, the light passing structure may be molded as a separate component and a diffuser film, such as those provided by Fusion Optics, Bright View Technologies or Luminit, may be used in conjunction with the light passing structure to provide a flame rated light passing structure and diffuser system.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting device comprising:

a first group of solid state light emitters, said first group of solid state light emitters comprising at least one first group solid state light emitter;

a second group of solid state light emitters, said second group of solid state light emitters comprising at least one second group solid state light emitter;

a power supply;

a housing;

a first current regulator; and a second current regulator, said first group of solid state light emitters, said second group of solid state light emitters, and said power supply within said housing, said power supply configured to supply power to said first group of solid state light emitters and said second group of solid state light emitters, said housing comprising at least one light passing structure, said light passing structure comprising at least a first thermoplastic material, and said light passing structure substantially transparent, said first current regulator being switchable among at least two first current regulator settings, said at least two first current regulator settings comprising a first current regulator first setting and a first current regulator second setting;

said second current regulator being switchable among at least two second current regulator settings, said at least two second current regulator settings comprising a second current regulator first setting and a second current regulator second setting;

such that:

(1) if said lighting device is energized and said first current regulator is in said first current regulator first setting, a first group first current would be supplied to said first group solid state light emitter;

(2) if said lighting device is energized and said first current regulator is in said first current regulator second setting, a first group second current would be supplied to said first group solid state light emitter;

(3) if said lighting device is energized and said second current regulator is in said second current regulator first setting, a second group first current would be supplied to said second group solid state light emitter; and (4) if said lighting device is energized and said second current regulator is in said second current regulator second setting, a second group second current would be supplied to said second group solid state light emitter;

a first group second setting/first setting ratio being defined as said first group second current divided by said first group first current, a second group second setting/first setting ratio being defined as said second group second current divided by said second group first current, said first group second setting/first setting ratio differing from said second group second setting/first setting ratio by at least 5%, the power supply comprising a lighting control circuit that comprises:

a duty cycle detection circuit configured to generate a first periodic waveform having a detection circuit duty cycle and detection circuit frequency corresponding to an input waveform duty cycle and input waveform frequency;

an averaging circuit responsive to the duty cycle detection circuit and configured to generate a first signal having a voltage level corresponding to the detection circuit duty cycle;

a waveform generator configured to output a second periodic waveform having a waveform generator frequency different from the input waveform frequency; and a comparator circuit configured to compare the second periodic waveform with the first signal to generate a comparator waveform having a comparator circuit duty cycle corresponding to the input waveform duty cycle and a comparator circuit frequency corresponding to the waveform generator frequency, wherein when power is supplied to said first group of solid state light emitters and said second group of solid state light emitters, said first group of solid state light emitters and said second group of solid state light emitters emit light source light, and at least a portion of said light source light passes through said light passing structure, and wherein:

[1] said first thermoplastic material is UL 94 5VA rated or

[2] said first thermoplastic material is UL 94 VO rated and said light passing structure passes the UL 94 5VA 5 inch flame test.

2. A lighting device as recited in claim 1, wherein said light passing structure passes at least 85 percent of light directed toward it.

3. A lighting device as recited in claim 1, wherein at least one of said first group of solid state light emitters or at least one of said second group of solid state light emitters comprises at least one light emitting diode.

4. A lighting device as recited in claim 1, wherein said at least one of said first group of solid state light emitters or at least one of said second group of solid state light emitters comprises at least one luminescent material.

5. A lighting device as recited in claim 1, wherein said thermoplastic material comprises polycarbonate.

6. A lighting device as recited in claim 1, wherein when power is supplied to said first group of solid state light emitters and said second group of solid state light emitters, said light source light which passes through said light passing structure is not more than 20 MacAdam ellipses from the blackbody locus.

7. A lighting device as recited in claim 1, wherein when energy is supplied to said lighting device, at least 200 lumens passes through said at least one light passing structure.

8. A lighting device as recited in claim 1, wherein said lighting device further comprises at least one optical layer.

9. A lighting device as recited in claim 1, wherein said power supply is configured to supply power to said first group of solid state light emitters and said second group of solid state light emitters at a voltage of at least 65 volts.

10. A lighting device as recited in claim 1, wherein the light passing structure comprises at least one material that has a Vicat softening temperature which is at least 85 degrees C.

11. A lighting device as recited in claim 1, wherein said lighting device further comprises a master currents regulator, said master currents regulator being switchable among at least two master currents regulator settings, said at least two master currents regulator settings comprising a master currents regulator first setting and a master currents regulator second setting, such that:

(1) if said master currents regulator is in said master currents regulator first setting, said first current regulator would be in said first current regulator first position and said second current regulator would be in said second current regulator first position, and (2) if said master currents regulator is in said master currents regulator second setting, said first current regulator would be in said first current regulator second position and said second current regulator would be in said second current regulator second position.

12. A lighting device comprising:

a first group of solid state light emitters, said first group of solid state light emitters comprising at least one first group solid state light emitter;

a second group of solid state light emitters, said second group of solid state light emitters comprising at least one second group solid state light emitter;

a power supply;

a housing;

a first current regulator; and a second current regulator, said first group of solid state light emitters, and said second group of solid state light emitters within said housing, said power supply configured to supply power to said first group of solid state light emitters and said second group of solid state light emitters at a voltage of at least 65 volts, said housing comprising at least one light passing structure, said light passing structure comprising at least a first thermoplastic material, and said light passing structure substantially transparent, said first current regulator being switchable among at least two first current regulator settings, said at least two first current regulator settings comprising a first current regulator first setting and a first current regulator second setting;

said second current regulator being switchable among at least two second current regulator settings, said at least two second current regulator settings comprising a second current regulator first setting and a second current regulator second setting;

such that:

(1) if said lighting device is energized and said first current regulator is in said first current regulator first setting, a first group first current would be supplied to said first group solid state light emitter;

(2) if said lighting device is energized and said first current regulator is in said first current regulator second setting, a first group second current would be supplied to said first group solid state light emitter;

(3) if said lighting device is energized and said second current regulator is in said second current regulator first setting, a second group first current would be supplied to said second group solid state light emitter; and (4) if said lighting device is energized and said second current regulator is in said second current regulator second setting, a second group second current would be supplied to said second group solid state light emitter;

a first group second setting/first setting ratio being defined as said first group second current divided by said first group first current, a second group second setting/first setting ratio being defined as said second group second current divided by said second group first current, said first group second setting/first setting ratio differing from said second group second setting/first setting ratio by at least 5%;

the power supply comprising a lighting control circuit that comprises:

a duty cycle detection circuit configured to generate a first periodic waveform having a detection circuit duty cycle and detection circuit frequency corresponding to an input waveform duty cycle and input waveform frequency;

an averaging circuit responsive to the duty cycle detection circuit and configured to generate a first signal having a voltage level corresponding to the detection circuit duty cycle;

a waveform generator configured to output a second periodic waveform having a waveform generator frequency different from the input waveform frequency; and a comparator circuit configured to compare the second periodic waveform with the first signal to generate a comparator waveform having a comparator circuit duty cycle corresponding to the input waveform duty cycle and a comparator circuit frequency corresponding to the waveform generator frequency, wherein when power is supplied to said first group of solid state light emitters and said second group of solid state light emitters, said first group of solid state light emitters and said second group of solid state light emitters emit light source light, and at least a portion of said light source light passes through said light passing structure, and wherein:

[1] said first thermoplastic material is UL 94 5VA rated or

[2] said first thermoplastic material is UL 94 VO rated and said light passing structure passes the UL 94 5VA 5 inch flame test.

13. A lighting device as recited in claim 12, wherein said light passing structure passes at least 85 percent of light directed toward it.

14. A lighting device as recited in claim 12, wherein at least one of said first group of solid state light emitters or at least one of said second group of solid state light emitters comprises at least one light emitting diode.

15. A lighting device as recited in claim 12, wherein said at least one of said first group of solid state light emitters or at least one of said second group of solid state light emitters comprises at least one luminescent material.

16. A lighting device as recited in claim 12, wherein said thermoplastic material comprises polycarbonate.

17. A lighting device as recited in claim 12, wherein when power is supplied to said first group of solid state light emitters and said second group of solid state light emitters, said light source light which passes through said light passing structure is not more than 20 MacAdam ellipses from the blackbody locus.

18. A lighting device as recited in claim 12, wherein when energy is supplied to said lighting device, at least 200 lumens passes through said at least one light passing structure.

19. A lighting device as recited in claim 12, wherein said lighting device further comprises at least one optical layer.

20. A lighting device as recited in claim 12, wherein said lighting device further comprises a master currents regulator, said master currents regulator being switchable among at least two master currents regulator settings, said at least two master currents regulator settings comprising a master currents regulator first setting and a master currents regulator second setting, such that:

(1) if said master currents regulator is in said master currents regulator first setting, said first current regulator would be in said first current regulator first position and said second current regulator would be in said second current regulator first position, and (2) if said master currents regulator is in said master currents regulator second setting, said first current regulator would be in said first current regulator second position and said second current regulator would be in said second current regulator second position.

21. A lighting device comprising:

a first group of solid state light emitters, said first group of solid state light emitters comprising at least one first group solid state light emitter;

a second group of solid state light emitters, said second group of solid state light emitters comprising at least one second group solid state light emitter;

a power supply;

a housing; and at least a first sensor, said first group of solid state light emitters, said second group of solid state light emitters, and said power supply within said housing, said power supply configured to supply power to said first group of solid state light emitters and said second group of solid state light emitters, said housing comprising at least one light passing structure, said light passing structure comprising at least a first thermoplastic material, and said light passing structure substantially transparent, said first sensor positioned such that when said first group of solid state light emitters and said second group of solid state light emitters are illuminated, said first sensor is exposed to combined light, said combined light comprising at least a portion of light emitted by said first group of solid state light emitters and at least a portion of light emitted by said second group of solid state light emitters, said first sensor sensitive to only a portion of said combined light, the power supply comprising a lighting control circuit that comprises:

a duty cycle detection circuit configured to generate a first periodic waveform having a detection circuit duty cycle and detection circuit frequency corresponding to an input waveform duty cycle and input waveform frequency;

an averaging circuit responsive to the duty cycle detection circuit and configured to generate a first signal having a voltage level corresponding to the detection circuit duty cycle;

a waveform generator configured to output a second periodic waveform having a waveform generator frequency different from the input waveform frequency; and a comparator circuit configured to compare the second periodic waveform with the first signal to generate a comparator waveform having a comparator circuit duty cycle corresponding to the input waveform duty cycle and a comparator circuit frequency corresponding to the waveform generator frequency, wherein when power is supplied to said first group of solid state light emitters and said second group of solid state light emitters, said first group of solid state light emitters and said second group of solid state light emitters emit light source light, and at least a portion of said light source light passes through said light passing structure, and wherein:

[1] said first thermoplastic material is UL 94 5VA rated or

[2] said first thermoplastic material is UL 94 VO rated and said light passing structure passes the UL 94 5VA 5 inch flame test.

22. A lighting device as recited in claim 21, wherein when power is supplied to said first group of solid state light emitters and said second group of solid state light emitters, said light source light which passes through said light passing structure is not more than 20 MacAdam ellipses from the blackbody locus.

23. A lighting device as recited in claim 21, wherein said lighting device further comprises at least one optical layer.

24. A lighting device as recited in claim 21, wherein said lighting device further comprises circuitry configured to adjust a current applied to at least a first of said second group of solid state light emitters based on an intensity of said portion of said combined light sensed by said first sensor.

25. A lighting device comprising:

a first group of solid state light emitters, said first group of solid state light emitters comprising at least one first group solid state light emitter;

a second group of solid state light emitters, said second group of solid state light emitters comprising at least one second group solid state light emitter;

a power supply;

a housing; and at least a first sensor, said first group of solid state light emitters and said second group of solid state light emitters within said housing, said power supply configured to supply power to said first group of solid state light emitters and said second group of solid state light emitters at a voltage of at least 65 volts, said housing comprising at least one light passing structure, said light passing structure comprising at least a first thermoplastic material, and said light passing structure substantially transparent, said first sensor positioned such that when said first group of solid state light emitters and said second group of solid state light emitters are illuminated, said first sensor is exposed to combined light, said combined light comprising at least a portion of light emitted by said first group of solid state light emitters and at least a portion of light emitted by said second group of solid state light emitters, said first sensor sensitive to only a portion of said combined light, the power supply comprising a lighting control circuit that comprises:

a duty cycle detection circuit configured to generate a first periodic waveform having a detection circuit duty cycle and detection circuit frequency corresponding to an input waveform duty cycle and input waveform frequency;

an averaging circuit responsive to the duty cycle detection circuit and configured to generate a first signal having a voltage level corresponding to the detection circuit duty cycle;

a waveform generator configured to output a second periodic waveform having a waveform generator frequency different from the input waveform frequency; and a comparator circuit configured to compare the second periodic waveform with the first signal to generate a comparator waveform having a comparator circuit duty cycle corresponding to the input waveform duty cycle and a comparator circuit frequency corresponding to the waveform generator frequency, wherein when power is supplied to said first group of solid state light emitters and said second group of solid state light emitters, said first group of solid state light emitters and said second group of solid state light emitters emit light source light, and at least a portion of said light source light passes through said light passing structure, and wherein:

[1] said first thermoplastic material is UL 94 5VA rated or

[2] said first thermoplastic material is UL 94 VO rated and said light passing structure passes the UL 94 5VA 5 inch flame test.

26. A lighting device as recited in claim 25, wherein said at least one solid state light emitter comprises at least one luminescent material.

27. A lighting device as recited in claim 25, wherein when power is supplied to said first group of solid state light emitters and said second group of solid state light emitters, said light source light which passes through said light passing structure is not more than 20 MacAdam ellipses from the blackbody locus.

28. A lighting device as recited in claim 25, wherein said lighting device further comprises at least one optical layer.

29. A lighting device as recited in claim 25, wherein said lighting device further comprises circuitry configured to adjust a current applied to at least a first of said second group of solid state light emitters based on an intensity of said portion of said combined light sensed by said first sensor.

* * * * *